US011939035B2

(12) United States Patent
Okamoto et al.

(10) Patent No.: US 11,939,035 B2
(45) Date of Patent: Mar. 26, 2024

(54) OUTBOARD MOTOR

(71) Applicant: YAMAHA HATSUDOKI KABUSHIKI KAISHA, Iwata (JP)

(72) Inventors: Shuhei Okamoto, Shizuoka (JP); Naoki Sugita, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 173 days.

(21) Appl. No.: 17/403,917

(22) Filed: Aug. 17, 2021

(65) Prior Publication Data

US 2022/0081087 A1 Mar. 17, 2022

(30) Foreign Application Priority Data

Sep. 11, 2020 (JP) ..... 2020-153169

(51) Int. Cl.

| | |
|---|---|
| ***B63H 20/32*** | (2006.01) |
| ***B63H 20/14*** | (2006.01) |
| ***B63H 20/24*** | (2006.01) |
| ***B63H 20/28*** | (2006.01) |

(52) U.S. Cl.

CPC ..... *B63H 20/32* (2013.01); *B63H 20/14* (2013.01); *B63H 20/245* (2013.01); *B63H 20/28* (2013.01)

(58) Field of Classification Search

CPC ..... B63H 20/32; B63H 20/14; B63H 20/245; B63H 20/28

See application file for complete search history.

(56) References Cited

U.S. PATENT DOCUMENTS 4,600,395 A * 7/1986 Pichl ..... B63H 20/285 440/89 R
8,998,663 B1 * 4/2015 Bonde ..... B63H 20/28 440/88 P

FOREIGN PATENT DOCUMENTS

| | | | |
|---|---|---|---|
| JP | 50-94319 U | | 8/1975 |
| JP | 62-19497 U | | 2/1987 |
| JP | 2015-145137 A | | 8/2015 |
| JP | 2015145137 A | * | 8/2015 |

OTHER PUBLICATIONS

Official Communication issued in corresponding European Patent Application No. 21189100.7, dated Feb. 3, 2022.

* cited by examiner

*Primary Examiner* — Syed O Hasan
(74) *Attorney, Agent, or Firm* — Keating & Bennett, LLP

(57) ABSTRACT

An outboard motor that significantly reduces or prevents discoloration around an exhaust opening includes an engine, a drive shaft, a propeller shaft, a housing, an exhaust passage, a water intake passage, and a valve. The exhaust passage guides an exhaust gas from the engine toward the discharge chamber inside the housing. The water intake passage guides water, which enters an inside of the housing, to the discharge chamber when a forward propulsive force is generated. The valve regulates passage of the exhaust gas at the first opening due to water pressure when a forward propulsive force is generated. The valve permits the passage of exhaust gas at the first opening due to exhaust pressure when a backward propulsive force is generated.

10 Claims, 11 Drawing Sheets

OUTBOARD MOTOR

CROSS REFERENCE TO RELATED APPLICATIONS

This application claims the benefit of priority to Japanese Patent Application No. 2020-153169 filed on Sep. 11, 2020. The entire contents of this application are hereby incorporated herein by reference.

BACKGROUND OF THE INVENTION

1. Field of the Invention

The present invention relates to an outboard motor.

2. Description of the Related Art

As a prior art, an outboard motor that includes a discharge passage for guiding exhaust gas from an engine is known (see Japanese Patent Application Laid-Open No. 2015-145137). In this type of outboard motor, generally, an exhaust opening for discharging the above exhaust gas from the discharge passage to the outside is provided on a housing of the outboard motor.

In the conventional outboard motor, the exhaust gas, which is discharged from the engine, is discharged from the inside of the outboard motor to the outside of the outboard motor via the exhaust opening. In this case, fuel, which is contained in the exhaust gas discharged from the exhaust opening, may adhere to an outer surface around the exhaust opening of the housing and discolor the outer surface of the housing. The discoloration often occurs when a watercraft moves forward.

SUMMARY OF THE INVENTION

Preferred embodiments of the present invention provide outboard motors that are each able to significantly reduce or prevent discoloration around an exhaust opening.

An outboard motor according to a preferred embodiment of the present invention includes an engine, a drive shaft, a propeller shaft, a housing, a first passage, a second passage, and a valve. The drive shaft extends downward from the engine. The propeller shaft extends in a direction intersecting with the drive shaft.

The housing accommodates the engine, the drive shaft, and the propeller shaft. The housing defines a discharge chamber. The discharge chamber discharges exhaust gas of the engine.

The first passage guides the exhaust gas from the engine to the discharge chamber inside the housing. The second passage guides water to the discharge chamber. The water enters the housing when a forward propulsive force is generated.

The valve regulates or permits passage of the exhaust gas at a first connection due to exhaust pressure and water pressure. The first connection connects the first passage and the discharge chamber. The exhaust pressure acts from the first passage toward the discharge chamber. The water pressure acts from the second passage toward the discharge chamber.

The valve regulates the passage of the exhaust gas at the first connection due to the water pressure when the forward propulsive force is generated. The valve permits the passage of the exhaust gas at the first connection due to the exhaust pressure when a backward propulsive force is generated.

In preferred embodiments of the present invention, outboard motors are each able to significantly reduce or prevent discoloration around an exhaust opening.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
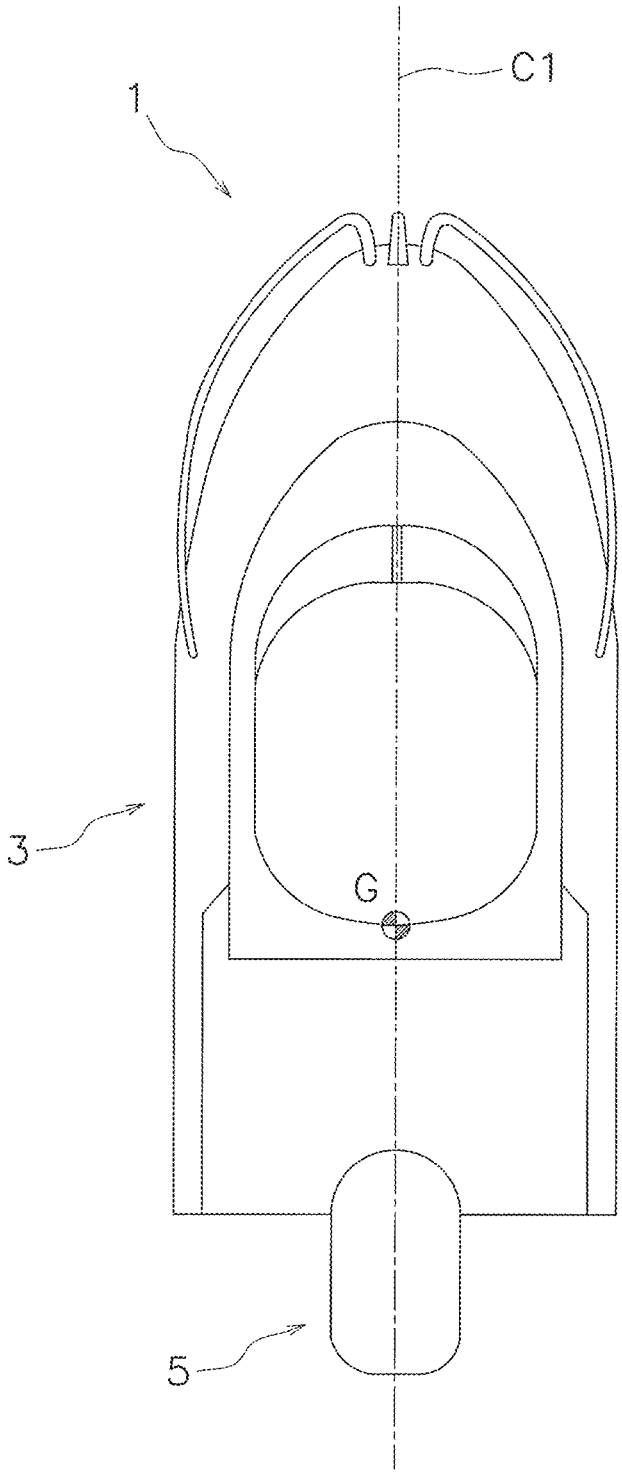
FIG. 1 is a top view of a watercraft according to a first preferred embodiment of the present invention.

The following preferred embodiments of the present invention will be described with reference to the drawings. As shown in FIG. 1, the watercraft 1 includes a hull 3 and an outboard motor 5. In the present preferred embodiment, an example in which a number of the outboard motors 5 is one is described. There may be a plurality of outboard motors 5.

In the following description, a direction of each of front, rear, left, right, up, and down refers to direction of each of front, rear, left, right, up, and down with respect to the hull 3. For example, as shown in FIG. 1, the center line C1 extending in a front-rear direction of the hull 3 passes through a center of gravity G of the hull 3.

The front-back direction is a direction along the center line C1. The front is an upward direction toward an upper side along the center line C1 of FIG. 1. The rear is a downward direction along the center line C1 of FIG. 1. In the present preferred embodiment, the front-rear direction of the outboard motor 5 is defined by an attitude of the hull 3 (an attitude of FIG. 1) when the outboard motor 5 moves the hull 3 in the front-rear direction. The left-right direction of FIG. 2 corresponds to the front-rear direction of the outboard motor 5.

The left-right direction (a width direction) is a direction perpendicular to the center line C1 in FIG. A left side is a direction perpendicular to the center line C1 of FIG. 1 and the direction toward a left side. A right side is a direction perpendicular to the center line C1 of FIG. 1 and the direction toward the right side. A vertical direction is a direction perpendicular to the front-back direction and the left-right direction.

Figure 2:
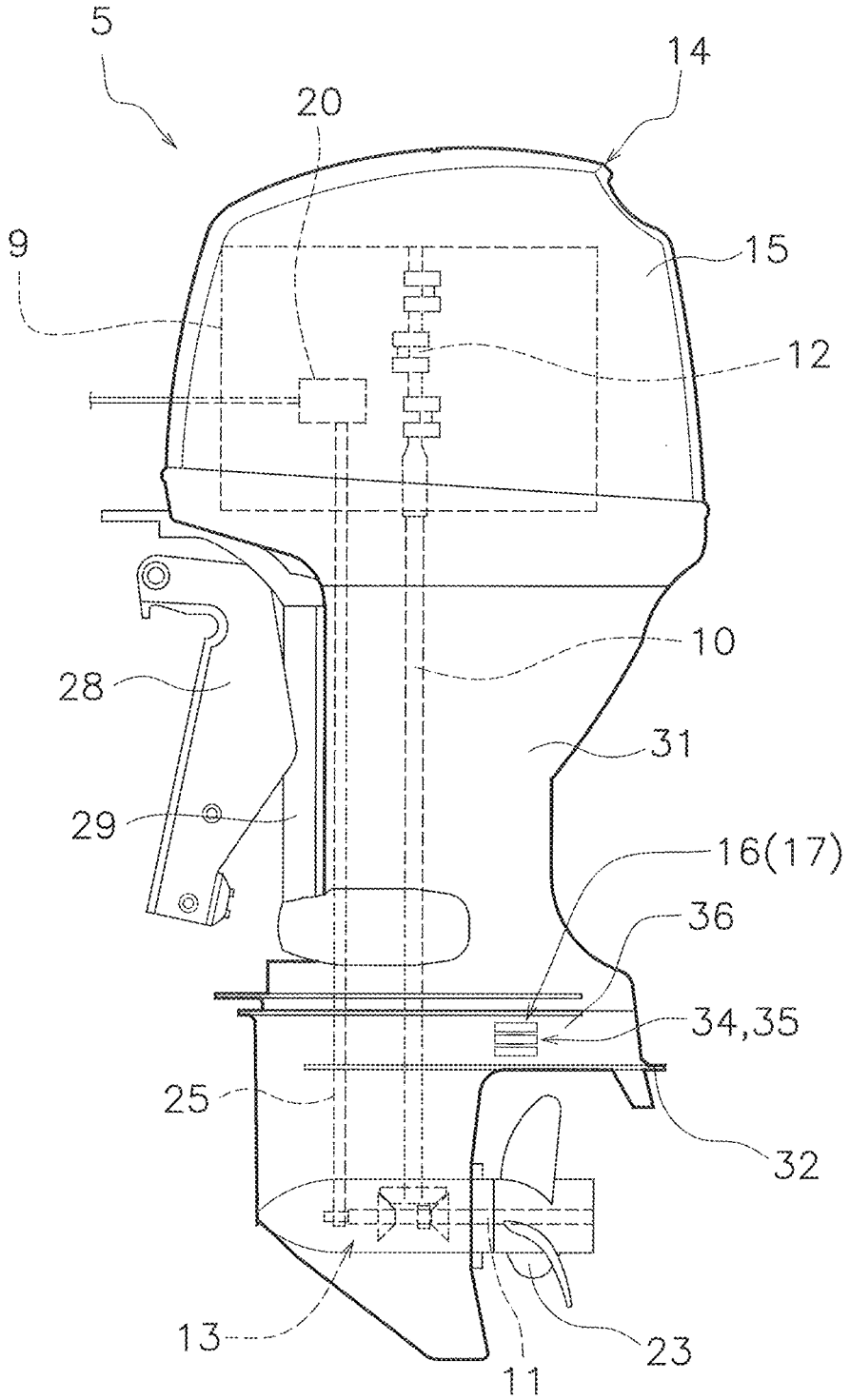
FIG. 2 is a side view of an outboard motor according to the first preferred embodiment of the present invention.
Figure 3A:
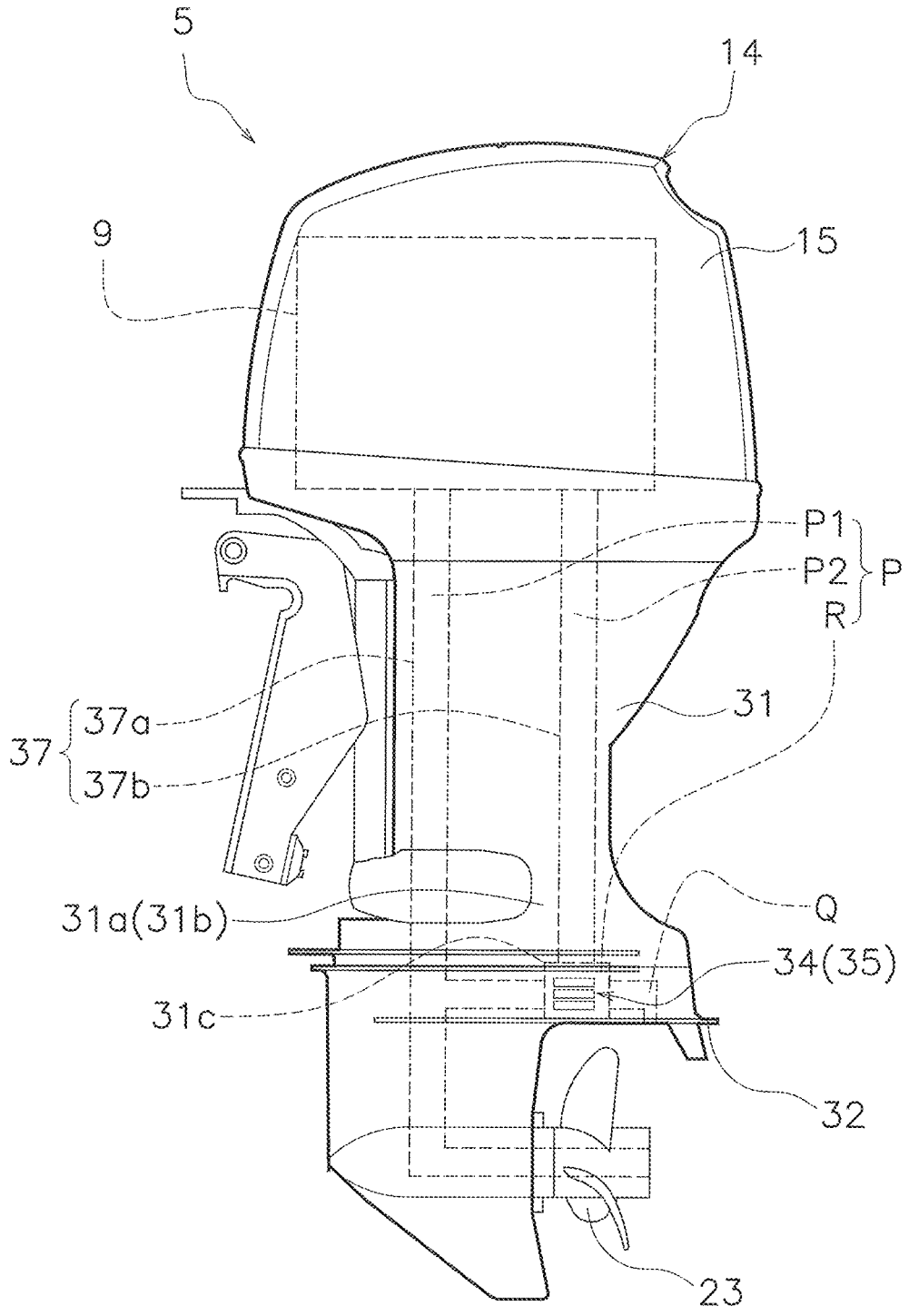
FIG. 3A is a side view of the outboard motor for explaining a discharge passage according to the first preferred embodiment of the present invention.

As shown in FIG. 2, the outboard motor 5 generates a propulsive force to propel the hull 3. The outboard motor 5 is attached to a stern of the hull 3. The outboard motor 5 includes an engine 9, a drive shaft 10, a propeller shaft 11, and a housing 14. The outboard motor 5 further includes a shift mechanism 13 and a bracket 28. As shown in FIG. 3A, the outboard motor 5 further includes a discharge passage P, a water intake passage Q (an example of a second passage), and a valve 40 (see FIG. 5).

The engine 9 is a power source that produces the propulsive force of the hull 3. The engine 9 is located in an engine cover 15. The engine 9 includes a crankshaft 12. The crankshaft 12 extends in the vertical direction.

The engine 9 is connected to the drive shaft 10. The drive shaft 10 extends in the vertical direction. For example, the drive shaft 10 extends downward from the engine 9. The propeller shaft 11 extends in a direction intersecting the drive shaft 10. In the present preferred embodiment, the propeller shaft 11 extends in the front-rear direction. The propeller shaft 11 is connected to the drive shaft 10 via the shift mechanism 13. A propeller 23 is connected to the propeller shaft 11.

The shift mechanism 13 is driven by a shift actuator 20 via the shift member 25. The shift mechanism 13 switches a rotation direction of the power which is transmitted from the drive shaft 10 to the propeller shaft 11. Thus, the rotation direction of the propeller 23 is switched to a forward direction in which the hull 3 moves forward or a reverse direction in which the hull 3 moves backward.

The bracket 28 is used to attach the outboard motor 5 to the hull 3. The outboard motor 5 is detachably fixed to the stern of the watercraft 1 via the bracket 28. The bracket 28 includes a steering shaft 29. The outboard motor 5 is rotatably supported by the bracket 28 about the steering shaft 29.

As shown in FIG. 2, the housing 14 accommodates the engine 9, the drive shaft 10, and the propeller shaft 11. Specifically, the housing 14 accommodates the engine 9, the drive shaft 10, the propeller shaft 11, and the shift mechanism 13.

As shown in FIG. 2, the housing 14 includes a discharge outlet 34, 35 which discharges an exhaust gas of the engine 9. Specifically, the housing 14 includes the engine cover 15, a housing body 31, and a pair of discharge outlets 34, 35. In the following, when the reference numeral of one of a pair is shown, the reference numeral of the other of the pair is shown in parentheses.

The engine cover 15 covers the engine 9. The engine 9 is located inside the engine cover 15. The engine cover 15 may be metal. The engine cover 15 may be resin.

The housing body 31 is located below the engine cover 15. The drive shaft 10, the propeller shaft 11, and the shift mechanism 13 are located inside the housing body 31. The housing body 31 may be metal. The housing body 31 may be resin.

A cavitation plate 32 is provided on the housing body 31. For example, the cavitation plate 32 is provided on the housing body 31 above the propeller 23. Specifically, the cavitation plate 32 is provided on the housing body 31 in the vertical direction between the propeller 23 and the engine 9.

As shown in FIG. 3A, the housing body 31 includes a wall 37 which defines the discharge passage P. For example, the wall 37 of the passage may be integral with the inner surface of the housing body 31. The housing body 31 further includes both sides 31*a*, 31*b* which define a discharge chamber R described below.

The pair of discharge outlets 34, 35 discharge the exhaust gas and a cooling water which is discharged from the engine 9. The pair of discharge outlets 34, 35 are provided on the housing 14. For example, the pair of discharge outlets 34, 35 are provided on the housing body 31 between the engine 9 and the cavitation plate 32.

The pair of discharge outlets 34, 35 are respectively provided on both sides 31*a*, 31*b* of the housing body 31. For example, the pair of discharge outlets 34, 35 are respectively provided on both sides 31*a*, 31*b* of the housing body 31 so as to face each other in the width direction (left-right direction).

Each of the pair of discharge outlets 34, 35 includes at least one opening. The at least one opening penetrates the housing body 31 from an inside of the housing body 31 toward an outside of the housing body 31. For example, the at least one opening penetrates each of the sides 31*a*, 31*b* which define the discharge chamber R. In the present preferred embodiment, an example is described in which each of the pair of discharge outlets 34, 35 includes a plurality of openings, for example, three openings, respectively.

As shown in FIG. 3A, the discharge passage P guides the exhaust gas and the cooling water from the engine 9 toward the pair of discharge outlets 34, 35 in the housing 14. The discharge passage P is defined by the housing 14. For example, the discharge passage P is defined by the housing body 31. The discharge passage P is defined by the wall 37 of the passage.

The discharge passage P includes the discharge chamber R, an exhaust passage P1 (an example of a first passage), and a cooling water passage P2.

The discharge chamber R is a space which is used to discharge the exhaust gas of the engine 9. In the present preferred embodiment, the discharge chamber R is a space which is used to guide the exhaust and the cooling water toward the pair of discharge outlets 34, 35. The discharge chamber R is a space which is provided in the housing body 31 to discharge the exhaust gas and the cooling water from the pair of discharge outlets 34, 35.

The discharge chamber R is provided inside the housing body 31 between the engine 9 and the cavitation plate 32. The discharge chamber R is defined by the housing body 31.

Figure 3B:
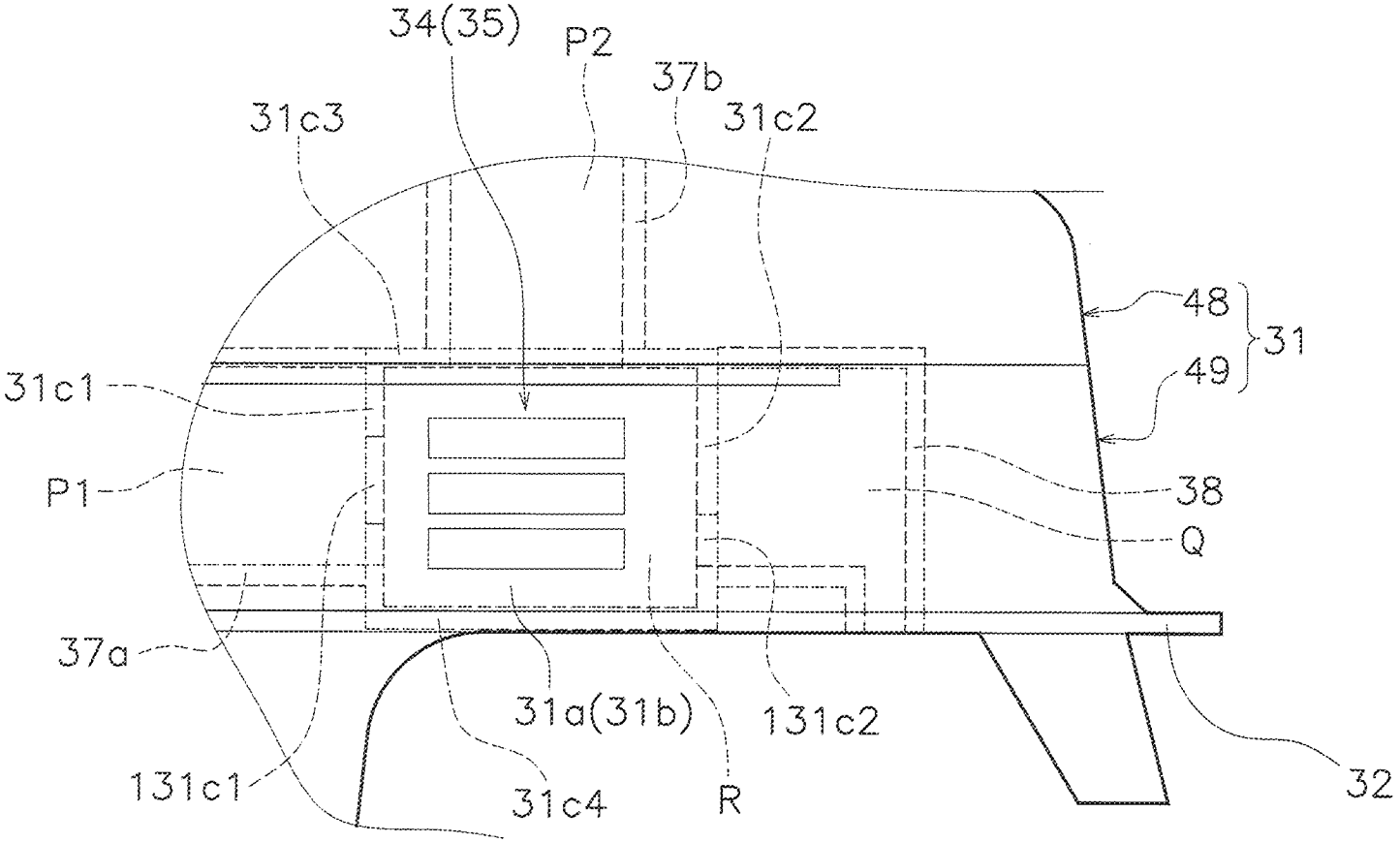
FIG. 3B is a side view in which a vicinity of a discharge chamber according to the first preferred embodiment of the present invention is partially enlarged.

For example, as shown in FIG. 3B, the discharge chamber R is defined by both sides 31*a*, 31*b* of the housing body 31 and walls 31*c* of the discharge chamber R. The walls 31*c* of the discharge chamber R are provided on the inner surfaces of the sides 31*a*, 31*b*. The sides 31*a*, 31*b* of the housing body 31 define side walls of the discharge chamber R.

The wall 31*c* of the discharge chamber R includes a front wall 31*c*1 of the discharge chamber R, a rear wall 31*c*2 of the discharge chamber R, an upper wall 31*c*3 of the discharge chamber R, and a lower wall 31*c*4 of the discharge chamber R. In FIG. 3B, the discharge passage P and the water intake passage Q are schematically shown.

In the present preferred embodiment, as shown in FIG. 3B, the housing body 31 includes an upper housing body 48 and a lower housing body 49. The upper housing body 48 defines an upper portion of the housing body 31. The upper housing body 48 defines the upper wall 31*c*3 of the discharge chamber R. The lower housing body 49 defines the lower portion of the housing body 31. The lower housing body 49 defines the front wall 31*c*1 of the discharge chamber R, the rear wall 31*c*2 of the discharge chamber R, and the lower wall 31*c*4 of the discharge chamber R.

As shown in FIG. 3B, the front wall 31*c*1 is located between the exhaust passage P1 and the discharge chamber R. For example, the front wall 31*c*1 includes a first opening 131*c*1 (an example of a first connection) which is used to pass the exhaust gas from the exhaust passage P1 to the discharge chamber R.

Exhaust pressure is generated by the exhaust gas which flows from the exhaust passage P1 toward the discharge chamber R. The exhaust pressure acts on the valve 40 (see FIG. 5), for example, a first wall 45 of a valve body 41 via the first opening 131*c*1. The first wall 45 of the valve body 41 is described below.

The rear wall 31*c*2 is provided between the water intake passage Q and the discharge chamber R. The rear wall 31*c*2 includes a second opening 131*c*2 (an example of a second connection) which is used to pass water from the water intake passage Q to the discharge chamber R.

Water pressure is generated by the water which flows from the water intake passage Q toward the discharge chamber R.

The water pressure acts on the valve 40 (see FIG. 5), for example, a second wall 46 of the valve body 41 via the second opening 131*c*2. The second wall 46 of the valve body 41 is described below.

An area of the second opening 131*c*2 is smaller than an area of the first opening 131*c*1. For example, the area of the second opening 131*c*2 viewed from the water intake passage Q (from a rear side) is smaller than the area of the first opening 131*c*1 viewed from the exhaust passage P1 (from a front side). The upper wall 31*c*3 and the lower wall 31*c*4 respectively define an upper surface and a lower surface of the discharge chamber R.

As shown in FIG. 3A, the exhaust passage P1 is provided inside the housing body 31. The exhaust passage P1 guides the exhaust gas from the engine 9 toward the discharge chamber R. The exhaust passage P1 is connected to the discharge chamber R.

For example, the exhaust passage P1 is defined by walls 37*a* for the exhaust gas which is provided on the inner surface of the housing body 31. The exhaust passage P1 is located in front of the discharge chamber R. The exhaust passage P1 extends downward from the engine 9 and is connected to the discharge chamber R. The exhaust gas is discharged from the discharge chamber R to the outside of the housing body 31 via the discharge outlets 34, 35 (the plurality of openings).

The exhaust passage P1 guides the exhaust gas to a rear portion of the propeller 23. The exhaust passage P1 is connected to a space which is defined by a portion at which the housing 14 (the housing body 31) supports the propeller 23.

The cooling water passage P2 guides the cooling water, which is used to cool the engine 9, from the engine 9 toward the discharge chamber R. The cooling water passage P2 is connected to the discharge chamber R. For example, the cooling water passage P2 is defined by walls 37*b* which are provided on the inner surface of the housing 14. The cooling water passage P2 extends downward from the engine 9 and is connected to the discharge chamber R. The cooling water is discharged from the discharge chamber R to the outside of the housing 14 through the discharge outlets 34, 35 (the plurality of openings).

As shown in FIG. 3A, the water intake passage Q is provided inside the housing body 31. The water intake passage Q guides the water from the outside of the outboard motor 5 toward the discharge chamber R. The water intake passage Q is connected to the discharge chamber R. The water intake passage Q is located behind the discharge chamber R.

For example, as shown in FIG. 3B, the water intake passage Q is defined by a lower surface of the cavitation plate 32 toward the discharge chamber R. The water intake passage Q is a space inside the housing body 31. This space is defined by the housing body 31 and the wall 38 which is provided on the inner surface of the housing body 31.

Figure 4:
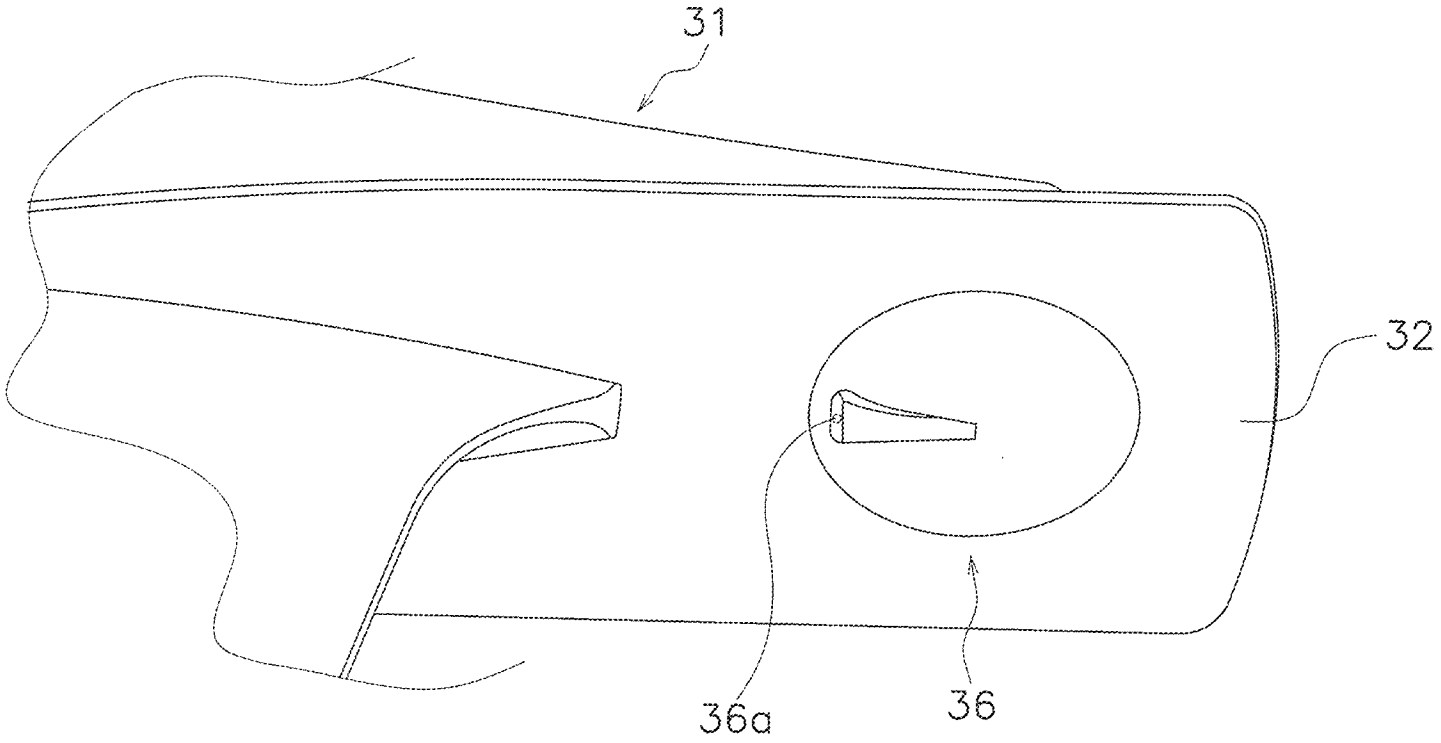
FIG. 4 is a perspective view in which the outboard motor is viewed from the lower side for explaining a water intake according to the first preferred embodiment of the present invention.

As shown in FIG. 4, the housing body 31 further includes a water intake 36. The water intake 36 takes water into the water intake passage Q when a forward propulsive force is generated. In the present preferred embodiment, the water intake 36 is mounted to the housing body 31 as a separate member. The water intake 36 may be integral with the housing body 31. The water intake 36 is located behind the discharge chamber R. For example, the water intake 36 is provided on the lower surface of the cavitation plate 32.

The water intake 36 includes an opening 36*a*. At least a portion of the opening opens forward. In the present preferred embodiment, the entire opening 36*a* opens forward. A portion of the opening 36*a* may be opened forward. For example, the opening 36*a* takes the water into the water intake passage Q when the forward propulsive force is generated. In other words, the water pressure acts from the front of the opening 36*a* toward the opening 36*a* when the forward propulsive force is generated. Thus, the pressure of water in the water intake passage Q rises.

Figure 5:
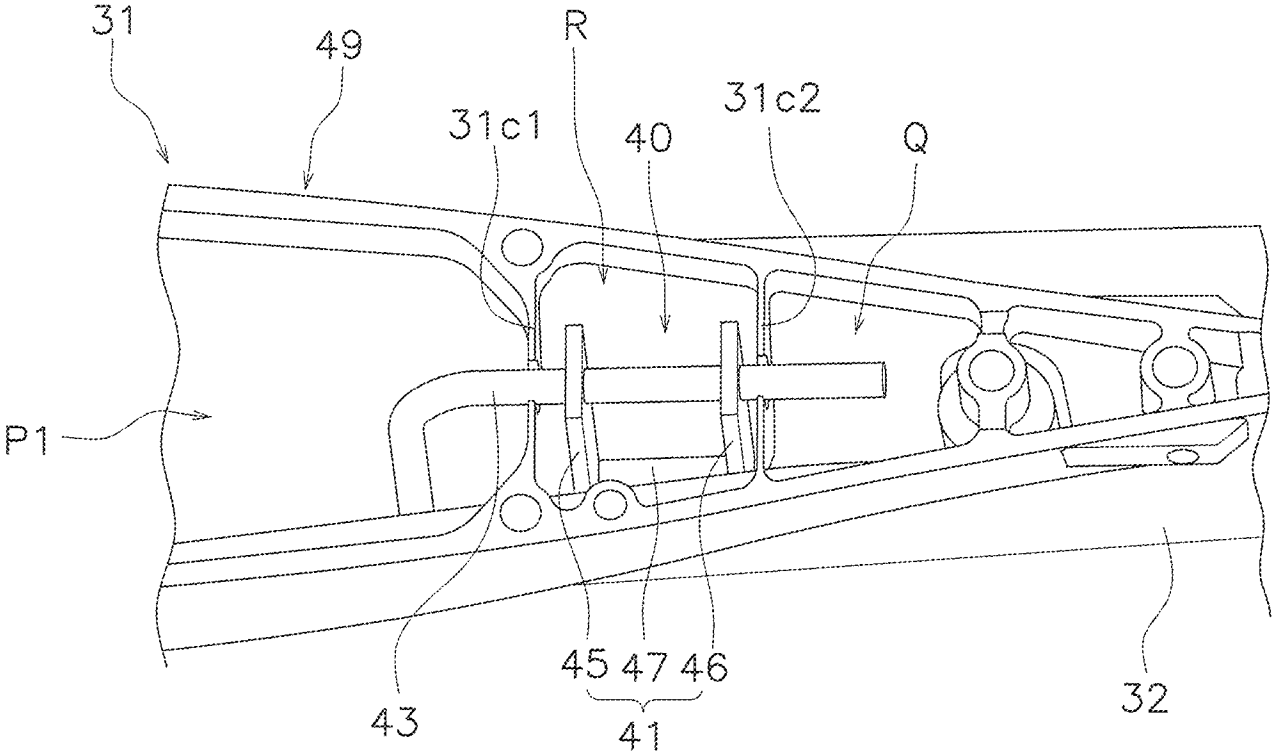
FIG. 5 is a perspective view in which a housing (a lower housing) according to the first preferred embodiment of the present invention is viewed from the upper side.
Figure 6A:
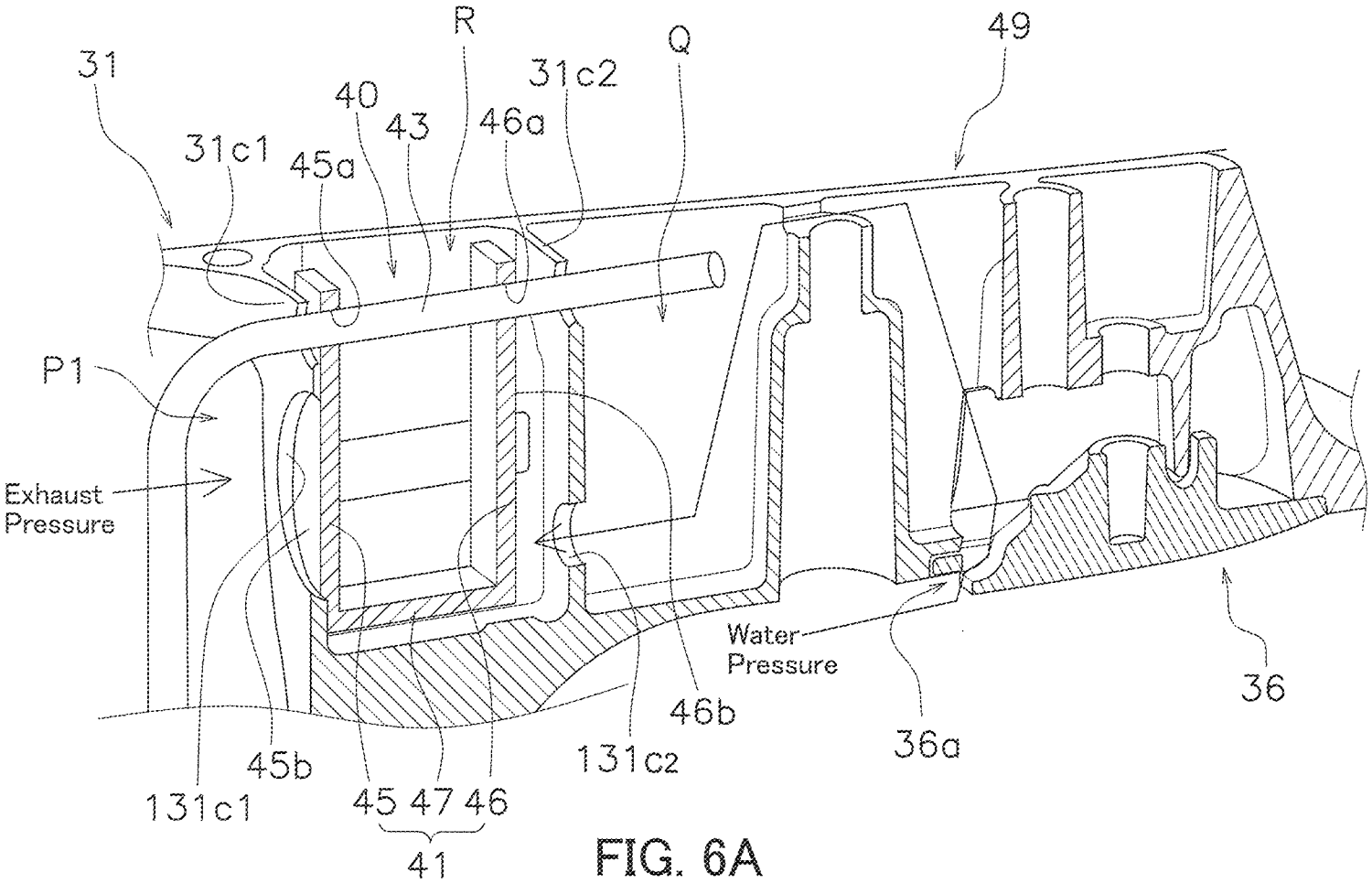
FIG. 6A is a cross-sectional view for explaining a valve according to the first preferred embodiment of the present invention.
Figure 6B:
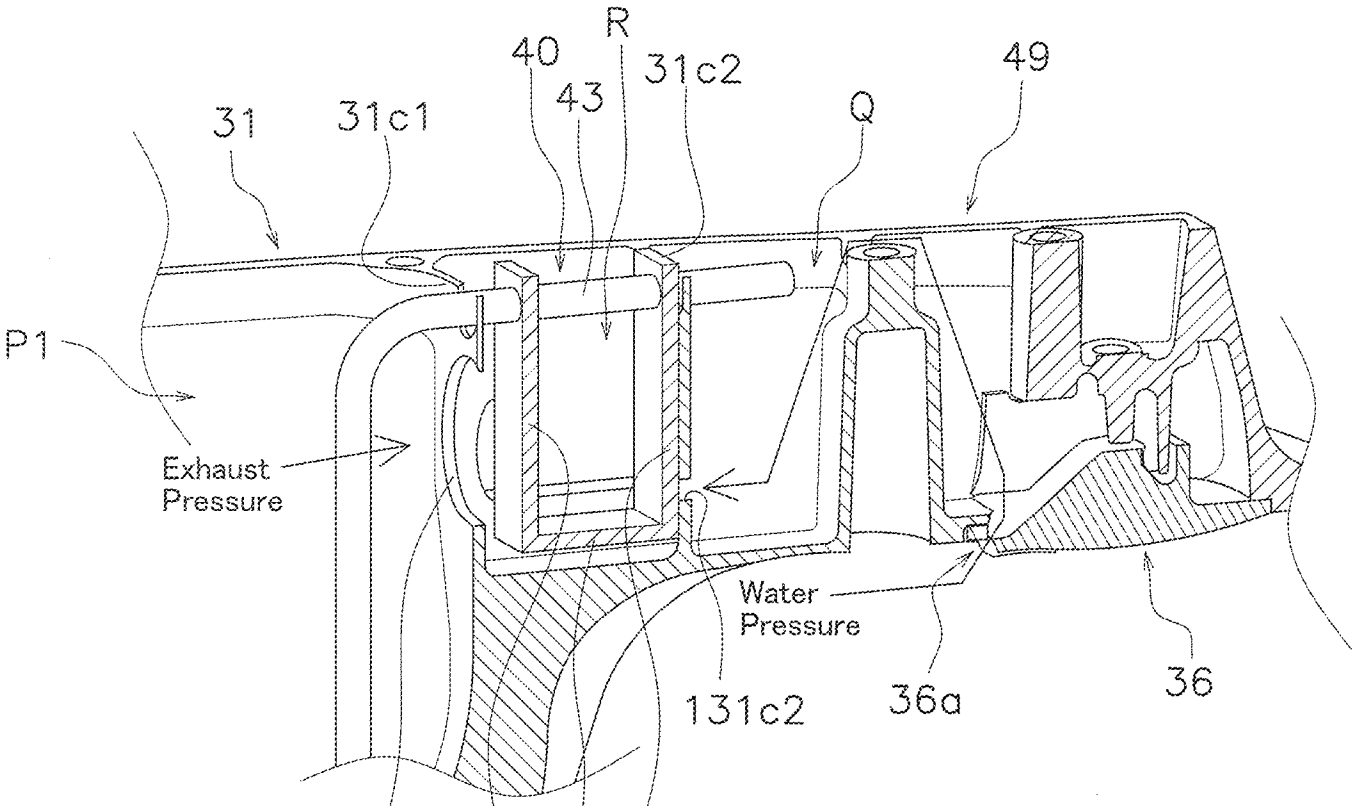
FIG. 6B is a cross-sectional view for explaining the valve according to the first preferred embodiment of the present invention.

As shown in FIGS. 5, 6A, and 6B, the valve 40 regulates or permits the passage of the exhaust gas at the front wall 31*c*1 due to the exhaust pressure and the water pressure. The exhaust pressure acts from the exhaust passage P1 toward the discharge chamber R. The water pressure acts from the water intake passage Q toward the discharge chamber R.

For example, as shown in FIG. 6A, the valve 40 regulates the passage of the exhaust gas at the front wall 31*c*1 due to the water pressure when the forward propulsive force is generated. Specifically, when the forward propulsive force is generated, the valve 40 closes the first opening 131*c*1 of the front wall 31*c*1 due to the water pressure because the water pressure becomes larger than the exhaust pressure.

As shown in FIG. 6B, the valve 40 permits the passage of the exhaust gas at the front wall 31*c*1 due to the exhaust pressure when a backward propulsive force is generated. Specifically, when the backward propulsive force is generated, the valve 40 opens the first opening 131*c*1 of the front wall 31*c*1 due to the exhaust pressure because the exhaust pressure becomes larger than the water pressure.

Specifically, as shown in FIGS. 5, 6A, and 6B, the valve 40 includes the valve body 41 and a guide 43 (an example of a support). The valve body 41 is located inside the discharge chamber R. The valve body 41 moves inside the discharge chamber R. For example, the valve body 41 moves inside the discharge chamber R in the front-rear direction. The valve body 41 includes the first wall 45, the second wall 46, and a connector 47.

As shown in FIGS. 6A and 6B, the first wall 45 is located behind the front wall 31*c*1 so as to face the front wall 31*c*1. Specifically, the first wall 45 is located behind the front wall 31*c*1 so as to face the first opening 131*c*1. The first wall 45 includes an opening 45*a* to receive the guide.

The second wall 46 is located behind the first wall 45 so as to face the first wall 45. The second wall 46 is located in front of the rear wall 31*c*2 so as to face the rear wall 31*c*2. Specifically, the second wall 46 is located in front of the rear wall 31*c*2 so as to face the second opening 131*c*2. The second wall 46 includes an opening 46*a* to receive the guide.

A distance between the outer surface 45*b* of the first wall 45 and the outer surface 46*b* of the second wall 46 (the distance in the front-rear direction) is smaller than a distance between the front wall 31*c*1 and the rear wall 31*c*2 (the distance in the front-rear direction).

The connector 47 connects the first wall 45 and the second wall 46. The connector 47 is located below the guide 43. The first wall 45, the second wall 46, and the connector 47 may be integral with each other.

As shown in FIGS. 5, 6A, and 6B, the guide 43 supports the valve body 41 so that the valve body 41 moves inside the discharge chamber R. For example, the guide 43 supports the valve body 41 so that the valve body 41 moves in the front-rear direction inside the discharge chamber R.

The guide 43 is provided on the housing body 31. For example, the guide 43 is rod-shaped. The guide 43 extends in the front-rear direction at an upper portion of the discharge chamber R. The guide 43 is inserted into the openings 45*a*, 46*a* of the first wall 45 and the second wall 46. In this state, the guide 43 is held by the front wall 31*c*1 of the housing body 31 and the rear wall 31*c*2 of the housing body 31. A pipe to supply the cooling water to the propeller 23 may be used as the guide 43.

As shown in FIG. 6A, when the forward propulsive force is generated, the valve body 41 moves toward the front wall 31*c*1 due to water pressure and closes the first opening 131*c*1 of the front wall 31*c*1. For example, when the forward propulsive force is generated, the water pressure acting on the second wall 46 of the valve body 41 becomes larger than the exhaust pressure acting on the first wall 45 of the valve body 41. Thus, the valve body 41 moves forward along the guide 43 and closes the first opening 131*c*1 of the front wall 31*c*1.

As shown in FIG. 6B, when the backward propulsive force is generated, the valve body 41 separates from the front wall 31*c*1 due to the exhaust pressure and opens the first opening 131*c*1. For example, when the backward propulsive force is generated, the exhaust pressure acting on the first wall 45 of the valve body 41 becomes larger than the water pressure acting on the second wall 46 of the valve body 41. Thus, the valve body 41 moves backward along the guide 43 and opens the first opening 131*c*1 of the front wall 31*c*1.

With the outboard motor 5 including the above configuration, the valve 40 regulates or permits the passage of exhaust gas at the first opening 131*c*1 connecting the exhaust passage P1 and the discharge chamber R.

For example, when the forward propulsive force is generated, the valve 40 regulates the passage of the exhaust gas at the first opening 131*c*1 due to the water pressure. In this case, discoloration around the discharge outlets 34, 35 is significantly reduced or prevented because the exhaust gas is not discharged from the discharge outlets 34, 35.

When the backward propulsive force is generated, the valve 40 permits the passage of the exhaust gas at the first opening 131*c*1 due to the exhaust pressure. In this case, the backward propulsive force is improved because the exhaust gas is discharged from the discharge outlets 34, 35.

With the outboard motor 5, the exhaust passage P1 is located in front of the discharge chamber R. The water intake passage Q is located behind the discharge chamber R. Thus, the exhaust gas is suitably regulated or permitted.

With the outboard motor 5, the water is suitably taken into the water intake passage Q because at least a portion of the opening 36*a* of the water intake 36 is opened toward the front.

With the outboard motor 5, a discharge regulation of the exhaust gas and a discharge permission of the exhaust gas is suitably realized due to the valve 40 moving the valve main body 41 inside the discharge chamber R.

With the outboard motor 5, the valve main body 41 includes the first wall 45, the second wall 46, and the connector 47. By configuring the valve body 41 in this way, the discharge regulation of the exhaust gas and the discharge permission of the exhaust gas is suitably realized by the valve 40.

With the outboard motor 5, the valve main body 41 is suitably moved inside the discharge chamber R by making the area of the first opening 131*c*1 larger than the area of the second opening 131*c*2.

Second Preferred Embodiment

The configuration of the second preferred embodiment of present invention is the substantially same as the configuration of the first preferred embodiment except for the valve 50. Thus, description of substantially same configuration of the first preferred embodiment is omitted in the second preferred embodiment. The configuration omitted here conforms to the configuration of the first preferred embodiment.

Figure 7:
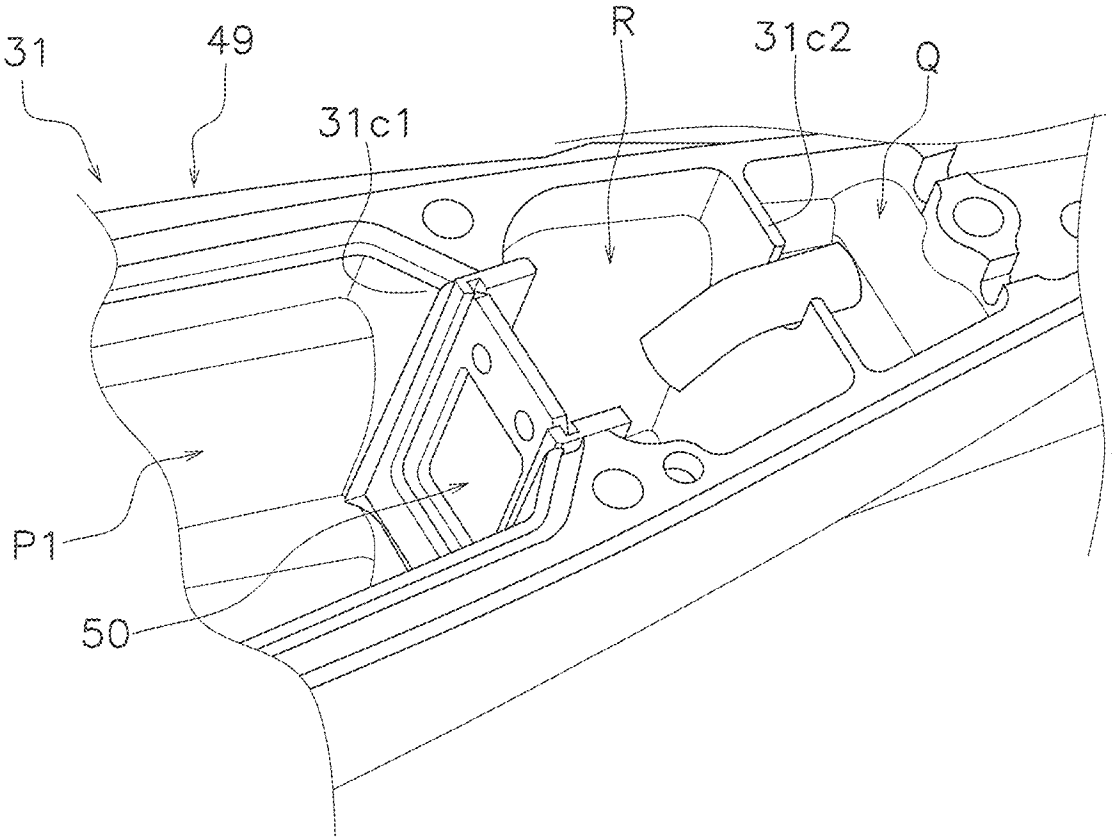
FIG. 7 is a perspective view in which a housing (a lower housing) according to a second preferred embodiment of the present invention is viewed from the upper side.
Figure 8A:
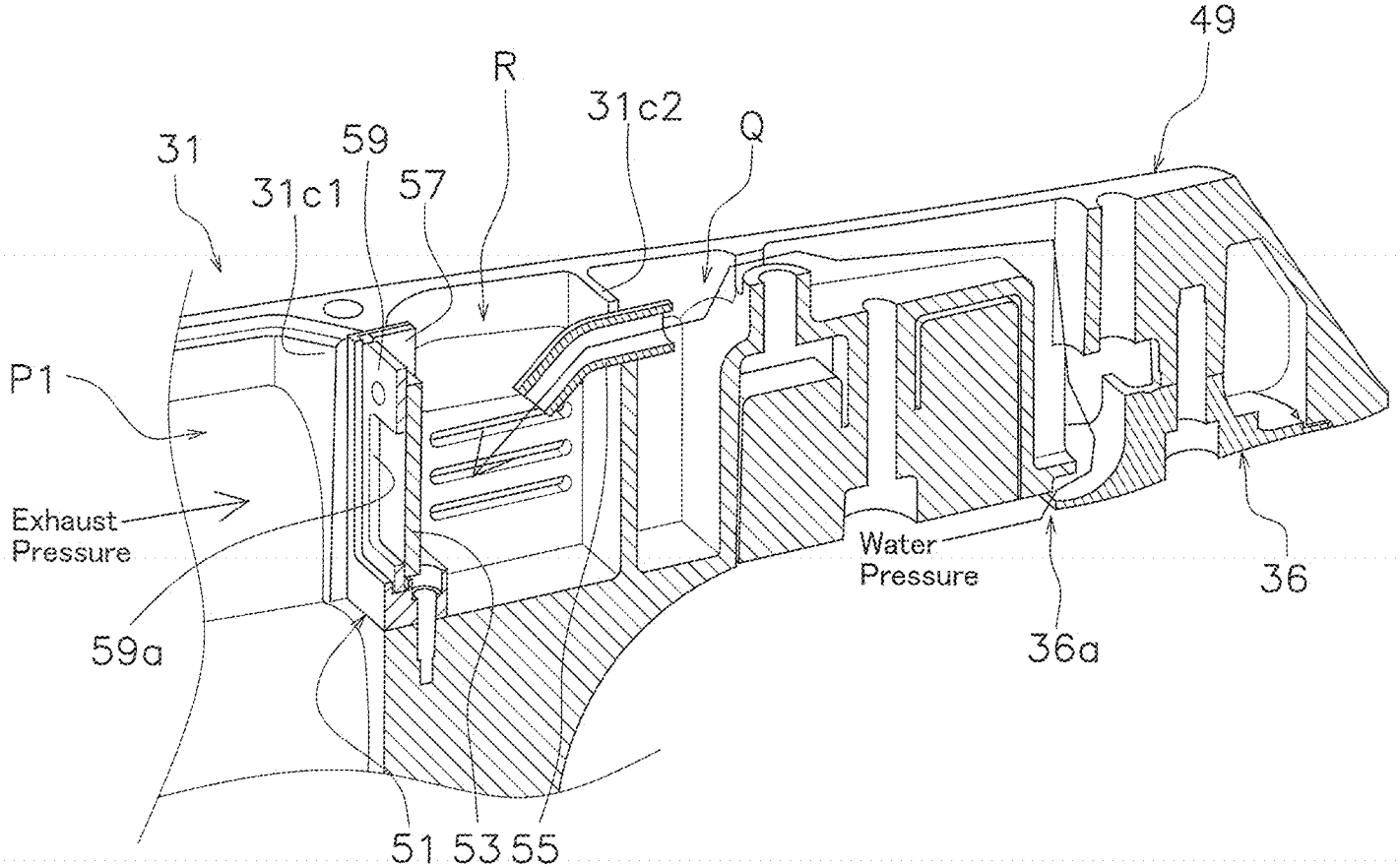
FIG. 8A is a cross-sectional view for explaining a valve according to the second preferred embodiment of the present invention.
Figure 8B:
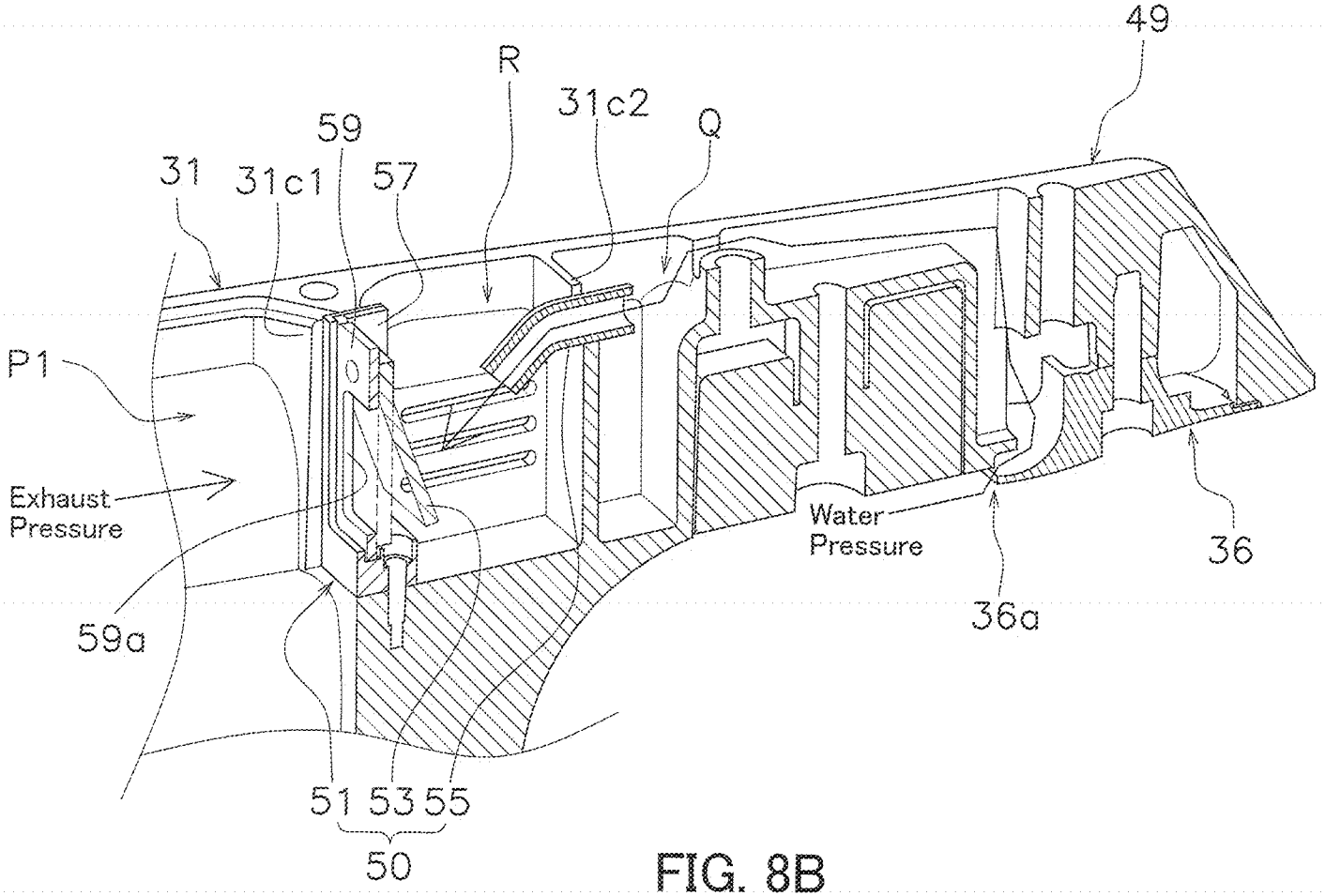
FIG. 8B is a cross-sectional view for explaining the valve according to the second preferred embodiment of the present invention.

As shown in FIGS. 7, 8A, and 8B, the valve 40 regulates or permits the passage of the exhaust gas at the front wall 31*c*1 due to the exhaust pressure and the water pressure. The exhaust pressure acts from the exhaust passage P1 toward the discharge chamber R. The water pressure acts from the water intake passage Q toward the discharge chamber R.

For example, as shown in FIG. 8A, the valve 40 regulates the passage of the exhaust gas at the front wall 31*c*1 due to the water pressure when the forward propulsive force is generated. Specifically, when the forward propulsive force is generated, the valve 40 closes due to the water pressure because the water pressure becomes larger than the exhaust pressure.

As shown in FIG. 8B, the valve 40 permits the passage of the exhaust gas at the front wall 31*c*1 due to the exhaust pressure when the backward propulsive force is generated. Specifically, when the backward propulsive force is generated, the valve 40 opens due to the exhaust pressure because the exhaust pressure becomes larger than the water pressure.

Specifically, as shown in FIGS. 7, 8A, and 8B, the valve 50 includes a frame 51 (an example of a support), a valve body 53, and a pipe 55 (an example of a guide).

As shown in FIGS. 8A and 8B, the frame 51 defines a third opening 59*a* (described below). The third opening 59*a* connects the exhaust passage P1 and the discharge chamber R. For example, the frame 51 defines the front wall 31*c*1 of the discharge chamber R. The frame 51 may define the entire front wall 31*c*1 of the discharge chamber R, or may define only a portion of the front wall 31*c*1 of the discharge chamber R.

The frame 51 supports the valve body 53. For example, the frame 51 includes a first frame 57 and a second frame 59. The first frame 57 is mounted to the housing body 31. The second frame 59 supports the valve body 53. The second frame 59 is detachably mounted to the first frame 57. The second frame 59 includes the third opening 59*a* (an example of the first connection).

The valve body 53 opens and closes the third opening 59*a*. The valve body 53 is deformed toward a discharge chamber R side due to the exhaust pressure. For example, the valve body 53 is elastic. The valve body 53 may be a metal that is elastic or a non-metal that is elastic.

As shown in FIGS. 8A and 8B, the valve body 53 is mounted to the frame 51. For example, the valve body 53 is mounted to a surface of the discharge chamber R side of the frame 51. Specifically, the valve main body 53 is mounted to the surface of the discharge chamber R side of the second frame 59 so as to cover the third opening 59*a*.

In this state, the valve body 53 is able to be detached from the first frame 57 together with the second frame 59. The valve body 53 is attached to the first frame 57 together with the second frame 59.

As shown in FIGS. 8A and 8B, the pipe 55 guides the water from the water intake passage Q toward the valve body 53. The pipe 55 is supported by the rear wall 31*c*2. One end of the pipe 55 is located in the water intake passage Q. The other end of the pipe 55 is located in the discharge chamber R.

As shown in FIG. 8A, the valve body 53 covers the third opening 59*a* of the frame 51 due to water pressure when the forward propulsive force is generated. For example, when the forward propulsive force is generated, the water pressure acting on the valve body 53 becomes larger than the exhaust pressure acting on the valve body 53. Thus, the valve body 53 is pressed against the second frame 59 and closes the third opening 59*a* of the second frame 59.

As shown in FIG. 8B, the valve body 53 opens the third opening 59*a* of the frame 51 due to the exhaust pressure when a backward propulsive force is generated. For example, when the backward propulsive force is generated, the exhaust pressure acting on the valve body 53 becomes larger than the water pressure acting on the valve body 53. Thus, the valve body 53 is partially separated from the second frame 59 and opens the third opening 59*a* of the second frame 59.

With the outboard motor 5 including the above configuration, the valve 50 regulates or permits the passage of exhaust gas at the third opening 59*a* connecting the exhaust passage P1 and the discharge chamber R.

With the outboard motor 5, the valve body 53 opens and closes the third opening 59*a* of the frame 51. For example, the valve body 53 closes the third opening 59*a* of the frame 51 due to water pressure when a forward propulsive force is generated. In this case, discoloration around the discharge outlets 34, 35 is significantly reduced or prevented because the exhaust gas is not discharged from the discharge outlets 34, 35.

Also, the valve body 53 opens the third opening 59*a* due to the exhaust pressure when the backward propulsive force is generated. In this case, the backward propulsive force is improved because the exhaust gas is discharged from the discharge outlets 34, 35.

With the outboard motor 5, the valve 50 has a simple configuration because the frame 51 defines the third opening 59*a* and supports the valve main body 53. Also, the valve main body 53 is easily maintained by detaching the valve main body 53 and the second frame 59 from the first frame 57 and attaching the valve main body 53 and the second frame 59 to the first frame 57.

With the outboard motor 5, the valve 50 has a simple configuration by deforming the valve body 53 toward the discharge chamber R side due to the exhaust pressure.

With the outboard motor 5, the water pressure is able to suitably act on the valve main body 53 because the water is guided from the water intake passage Q toward the valve main body 53 with the pipe 55.

The structures of the above-described preferred embodiments of the present invention may be configured as follows.

In the above-described preferred embodiments, an example is described in which the exhaust passage P1 and the cooling water passage P2 are connected to the discharge chamber R. Instead of this, one of the exhaust passage P1 and the cooling water passage P2 may be connected to the other of the exhaust passage P1 and the cooling water passage P2, and the other of the exhaust passage P1 and the cooling water passage P2 may be connected to the discharge chamber R.

In this case, the walls 37*a* shown in FIG. 3A are connected to the walls 37*b* of the cooling water passage P2 which is provided between the engine 9 and the discharge chamber R. The same effects as the above effects are obtained with this configuration.

In the above-described preferred embodiments, an example is described in which the exhaust passage P1 and the cooling water passage P2 are connected to the discharge chamber R. Instead of this, only the exhaust passage P1 may be connected to the discharge chamber R, and the above valves 40, 50 may be located in the housing 14. The same effects as the above effects are obtained with this configuration.

According to preferred embodiments of the present invention, outboard motors are able to significantly reduce or prevent discoloration around an exhaust opening.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a drive shaft extending downward from the engine;

a propeller shaft extending in a direction intersecting with the drive shaft;

a housing to accommodate the engine, the drive shaft, and the propeller shaft and that defines a discharge chamber to discharge exhaust gas from the engine;

a first passage to guide the exhaust gas from the engine to the discharge chamber inside the housing;

a second passage to guide water to the discharge chamber that enters the housing when a forward propulsive force is generated; and a valve to regulate or permit passage of the exhaust gas at a first connection due to exhaust pressure and water pressure, the first connection connecting the first passage and the discharge chamber, the exhaust pressure acting from the first passage toward the discharge chamber, and the water pressure acting from the second passage toward the discharge chamber; wherein the valve regulates the passage of the exhaust gas at the first connection due to the water pressure when the forward propulsive force is generated;

the valve permits the passage of the exhaust gas at the first connection due to the exhaust pressure when a backward propulsive force is generated;

the housing includes a water intake to take the water into the second passage when the forward propulsive force is generated; and the water intake includes an opening, and at least a portion of the opening opens forward.

2. The outboard motor according to claim 1, wherein the first passage is located in front of the discharge chamber; and the second passage is located behind the discharge chamber.

3. The outboard motor according to claim 1, wherein the first connection includes a first opening to pass the exhaust gas;

the valve includes a valve body to move inside the discharge chamber;

the valve body moves toward the first connection due to the water pressure and closes the first opening when the forward propulsive force is generated; and the valve body is separated from the first connection due to the exhaust pressure and opens the first opening when the backward propulsive force is generated.

4. The outboard motor according to claim 3, wherein the valve further includes a support; and the support is provided on the housing and supports the valve body so that the valve body moves inside the discharge chamber.

5. The outboard motor according to claim 4, wherein the housing includes a second connection connecting the second passage and the discharge chamber;

the second connection includes a second opening to pass the water;

the valve body includes a first wall facing the first opening, a second wall facing the second opening, and a connector connecting the first wall and the second wall; and the support is inserted into the first wall and the second wall.

6. The outboard motor according to claim 3, wherein the housing includes a second connection connecting the second passage and the discharge chamber;

the second connection includes a second opening to pass the water; and an area of the first opening is larger than an area of the second opening.

7. The outboard motor according to claim 1, wherein the valve includes a valve body to open and close the first connection;

the valve body closes the first connection due to the water pressure when the forward propulsive force is generated; and the valve body opens the first connection due to the exhaust pressure when the backward propulsive force is generated.

8. The outboard motor according to claim 7, wherein the valve further includes a support;

the support defines the first connection and supports the valve body.

9. The outboard motor according to claim 8, wherein the valve body is mounted to the support and deforms toward the discharge chamber due to the exhaust pressure.

10. The outboard motor according to claim 7, wherein the valve further includes a guide; and the guide guides the water from the second passage toward the valve body.

* * * * *